US006997150B2

(12) United States Patent
Simpson

(10) Patent No.: US 6,997,150 B2
(45) Date of Patent: Feb. 14, 2006

(54) CTA PHASER WITH PROPORTIONAL OIL PRESSURE FOR ACTUATION AT ENGINE CONDITION WITH LOW CAM TORSIONALS

(75) Inventor: Roger T. Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/984,592

(22) Filed: Nov. 9, 2004

(65) Prior Publication Data

US 2005/0103297 A1 May 19, 2005

Related U.S. Application Data

(60) Provisional application No. 60/520,594, filed on Nov. 17, 2003.

(51) Int. Cl.
*F01L 1/34* (2006.01)

(52) U.S. Cl. ..... 123/90.17; 123/90.15; 123/90.16; 123/90.31; 123/90.12; 464/1; 464/2; 464/160; 92/67; 92/68; 92/69 R; 92/75; 92/120; 92/122; 74/568 R

(58) Field of Classification Search ..... 123/90.17; 92/120, 122; 464/160
See application file for complete search history.

(56) References Cited

U.S. PATENT DOCUMENTS

| | | | | |
|---|---|---|---|---|
| 5,657,725 | A | 8/1997 | Butterfield et al. | 123/90.17 |
| 6,276,321 | B1 | 8/2001 | Lichti et al. | 123/90.17 |
| 6,382,155 | B2 * | 5/2002 | Simpson | 123/90.17 |
| 6,453,859 | B1 | 9/2002 | Smith et al. | 123/90.17 |
| 6,591,799 | B1 | 7/2003 | Hase et al. | 123/90.17 |
| 6,763,791 | B2 | 7/2004 | Gardner et al. | 123/90.17 |

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

A variable camshaft timing phaser for an internal combustion engine having at least one camshaft comprising a plurality of vanes in chambers defined by a housing and a spool valve. The vanes define an advance and retard chamber. At least one of the vanes is cam torque actuated (CTA) and at least one of the other vanes is oil pressure actuated (OPA). The spool valve is coupled to the advance and retard chamber defined by the CTA vane and the advance chamber defined by the OPA vane. When the phaser is in the advance position, fluid is routed from the retard chamber defined by the OPA vane to the retard chamber defined the CTA vane. When the phaser is in the retard position fluid is routed from the retard chamber defined by the CTA vane to the advance chamber defined by the CTA vane.

5 Claims, 7 Drawing Sheets

CTA PHASER WITH PROPORTIONAL OIL PRESSURE FOR ACTUATION AT ENGINE CONDITION WITH LOW CAM TORSIONALS

REFERENCE TO RELATED APPLICATIONS

This application claims an invention, which was disclosed in Provisional Application No. 60/520,594, filed Nov. 17, 2003, entitled "CTA PHASER WITH PROPORTIONAL OIL PRESSURE FOR ACTUATION AT ENGINE CONDITION WITH LOW CAM TORSIONALS." The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains to an apparatus for allowing actuation of a phaser during low cam torsionals.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a housing with one or more vanes, mounted to the end of the camshaft, surrounded by a housing with the vane chambers into which the vanes fit. It is possible to have the vanes mounted to the housing, and the chambers in the housing, as well. The housing's outer circumference forms the sprocket, pulley or gear accepting drive force through a chain, belt or gears, usually from the camshaft, or possibly from another camshaft in a multiple-cam engine.

Two types of phasers are Cam Torque Actuated (CTA) and Oil Pressure Actuated (OPA). In OPA or TA phasers, the engine oil pressure is applied to one side of the vane or the other, in the retard or advance chamber, to move the vane. Motion of the vane due to forward torque effects is permitted.

In a CTA phaser, the variable cam timing system uses torque reversals in the camshaft caused by the forces of opening and closing engine valves to move the vane. Control valves are present to allow fluid flow from chamber to chamber causing the vane to move, or to stop the flow of oil, locking the vane in position. The CTA phaser has oil input to make up for losses due to leakage but does not use engine oil pressure to move the phaser. CTA phasers have shown that they provide fast response and low oil usage, reducing fuel consumption and emissions. However, in some engines, i.e. 4 cylinder, the torsional energy from the camshaft is not sufficient to actuate the phaser over the entire speed range of the engine, especially the speed range where the rpm is high.

FIG. 7 shows a graph of actuation rate versus rpm. When the revolutions per minute (rpm) is low, cam torsional energy is high. When rpm is high, cam torsional energy drops off. The actuation rate for an oil pressure actuated (OPA) or torsion assist (TA) phaser is shown by the dashed line. Since oil pressure is low at low rpm, the actuation rate is also low. As the rpm increases, the oil pressure increases and the actuation rate of the OPA or TA phaser also increases. The solid line shows the actuation rate of the cam torque actuated (CTA) phaser. The CTA phaser is actuated by torsional energy, which is high at low rpm and low and higher rpm.

Numerous strategies have been used to solve the problem of low cam torsional energy at high rpm or high engine speeds. For example, if the position of the cam phaser was to full retard during the periods of low torsional energy, the friction of the cam drive may be used to pull the phaser back to the full retard position. Another strategy is to add a bias spring to help move and hold the phaser to a full advance position during periods of low torsional energy. Other examples are shown in U.S. Pat. Nos. 6,276,321, 6,591,799, 5,657,725, and 6,453,859.

U.S. Pat. No. 6,276,321 uses a spring attached to a cover plate to move the rotor to an advanced or retard position to enable a locking pin to slide into place during low engine speeds and oil pressure.

U.S. Pat. No. 6,591,799 discloses a valve timing control device that includes a biasing means for biasing the camshaft in an advanced direction where, the biasing force is approximately equal to or smaller than a peak value of frictional torque produced between a cam and a tappet.

U.S. Pat. No. 5,657,725 discloses a CTA phaser that supplies full pressure to an ancillary vane that provides bias to the phaser based on the pressure of the oil pump. The oil pressure bias uses an open pressure port and lacks proportional control at high engine speeds.

U.S. Pat. No. 6,453,859 discloses a single spool valve controlling a phaser having both a cam torque actuated and a two check valve torsional assist (TA) properties. A valve switch function is used to switch from CTA to TA during periods of low torsional energy.

SUMMARY OF THE INVENTION

A variable camshaft timing phaser for an internal combustion engine having at least one camshaft comprising a plurality of vanes in chambers defined by a housing and a spool valve. The vanes define an advance and retard chamber. At least one of the vanes is cam torque actuated (CTA) and at least one of the other vanes is oil pressure actuated (OPA) or torsion assist (TA). The spool valve is coupled to the advance and retard chamber defined by the CTA vane and the advance chamber defined by the OPA vane. When the phaser is in the advance position, fluid is routed from the retard chamber defined by the OPA vane to the retard chamber defined the CTA vane. When the phaser is in the retard position fluid is routed from the retard chamber defined by the CTA vane to the advance chamber defined by the CTA vane.

The phaser further comprises a locking pin located in one of the vanes. The locking pin is in the locked position when the locking pin is received in the receiving hole in the housing. The receiving hole is located at the fully advance stop position or the filly retard stop position, depending on whether the phaser is exhaust or intake.

DETAILED DESCRIPTION OF THE INVENTION

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

Figure 8B:
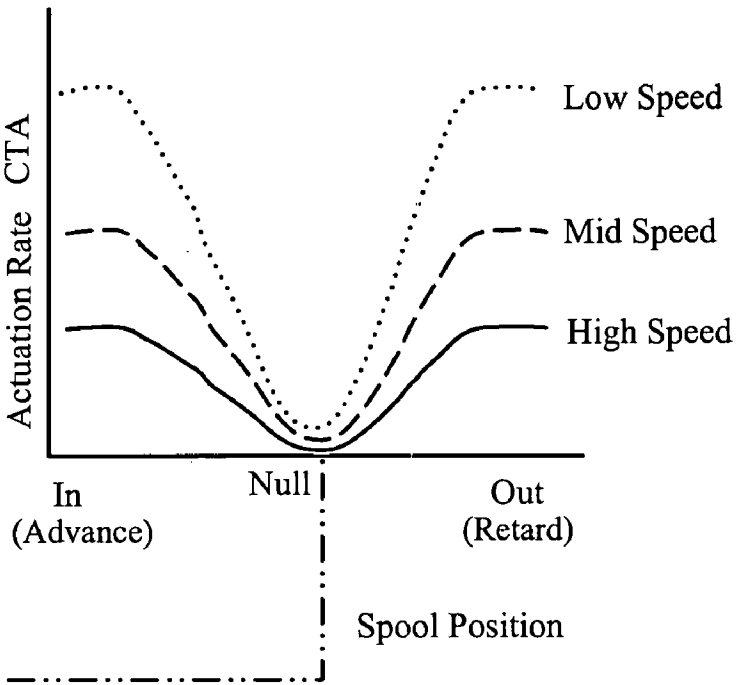
FIG. 8*b* shows a graph of actuation rate of an CTA phaser versus spool position at various speeds.
Figure 8A:
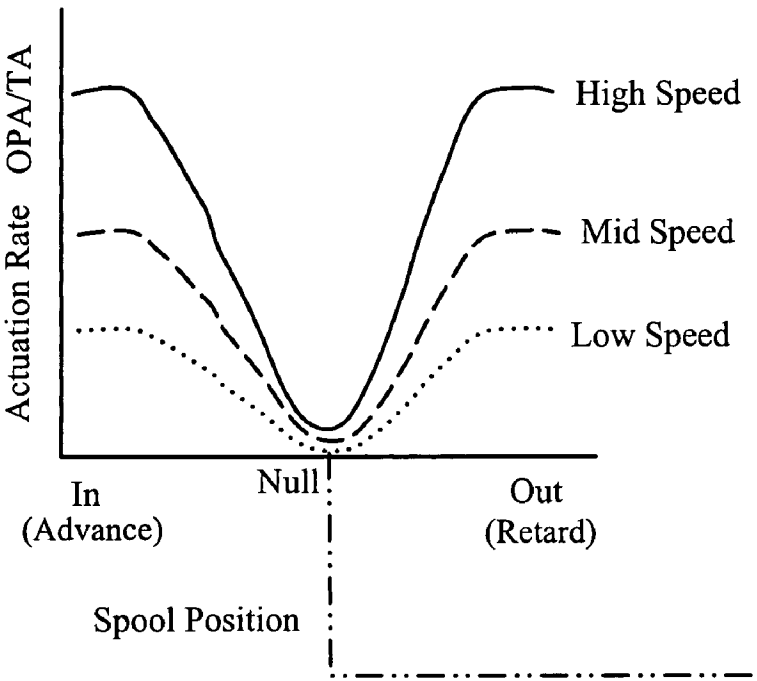
FIG. 8*a* shows a graph of actuation rate of an OPA/TA phaser versus spool position at various speeds.

FIGS. 8*a* and 8*b* show graphs of actuation rate versus spool position in OPA/TA phasers and in CTA phasers. As shown in FIG. 8*a*, the actuation rate is highest at high speeds, indicated by the solid line, and when the spool is in the inner position and the outer position for the OPA/TA phasers. The actuation rate is lowest at low speed, indicated by the dotted line. At mid speed, indicated by the dashed line, the actuation rate is between the actuation rates of the phaser at high speeds and low speeds. FIG. 8*b* shows the highest actuation rates for the CTA phaser, when the phaser is operating at low speeds, indicated by the dotted line, and the spool is in the inner and the outer positions. The actuation rate of the CTA phaser at high speeds, indicated by the solid line, is low. At mid speed, indicated by the dashed line, the actuation rate is between the actuation rates of the phaser at high speeds and low speeds. As shown by comparing the graphs, the null position is the same in both the OPA/TA phasers and the CTA phaser. Furthermore, the actuation of the CTA phaser at high speed may be aided by actuation of the OPA or TA phaser at high speeds, such that the sum of the two actuations at a given speed results in satisfactory engine performance, even in a four cylinder engine.

Figure 1:
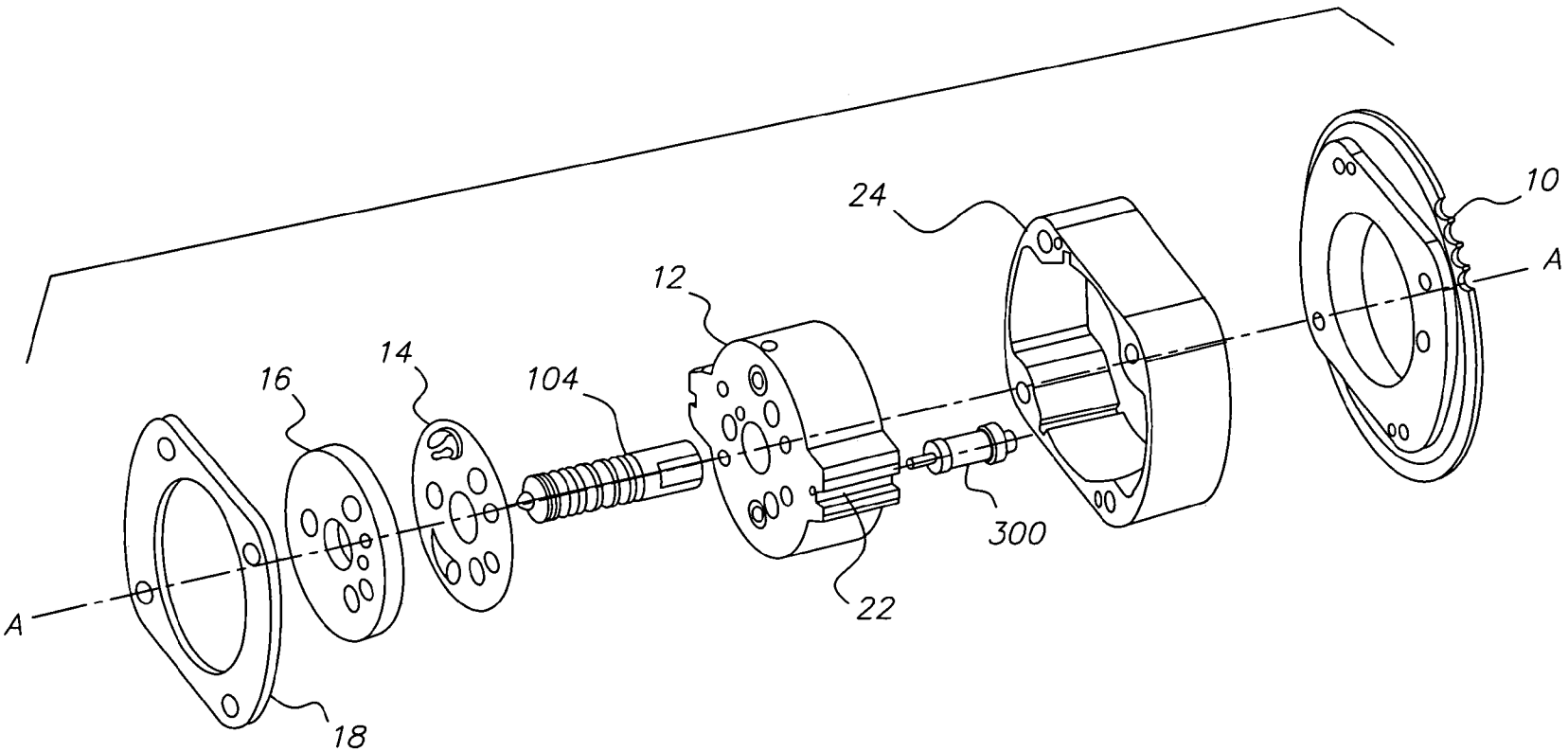
FIG. 1 shows a perspective view of the present invention
Figure 2:
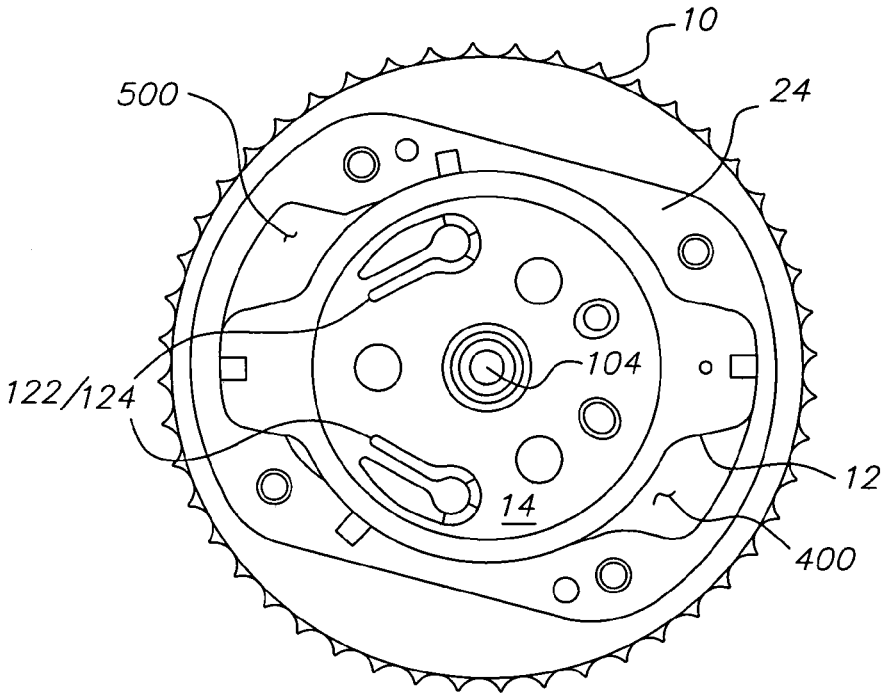
FIG. 2 shows an end view of the FIG. 1 with the cover plate and spacer plate removed.
Figure 3:
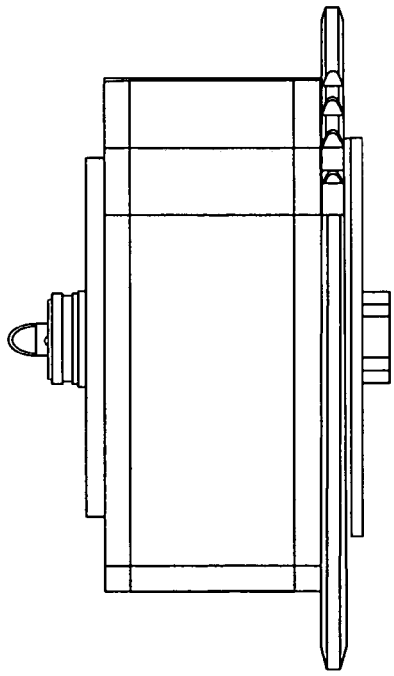
FIG. 3 shows a side view of FIG. 1 along line A—A.

Referring to FIGS. 1–3, a sprocket 10 is connected to the housing 24. The rotor 12 has a diametrically opposed pair of radially outward projecting vanes 22, which fit into the housing 24. The rotor 12 houses the spool 104 and locking pin 300. One of the vanes 22 of the rotor 12 contains locking pin 300. Locking pin 300 is received by a receiving hole 151 located in the housing 24. Connected to the rotor 12 is a reed check valve plate 14, containing at least two check valves 122 and 124. A cover 18 and spacer 16 are attached to the reed check valve plate 14.

Figure 4:
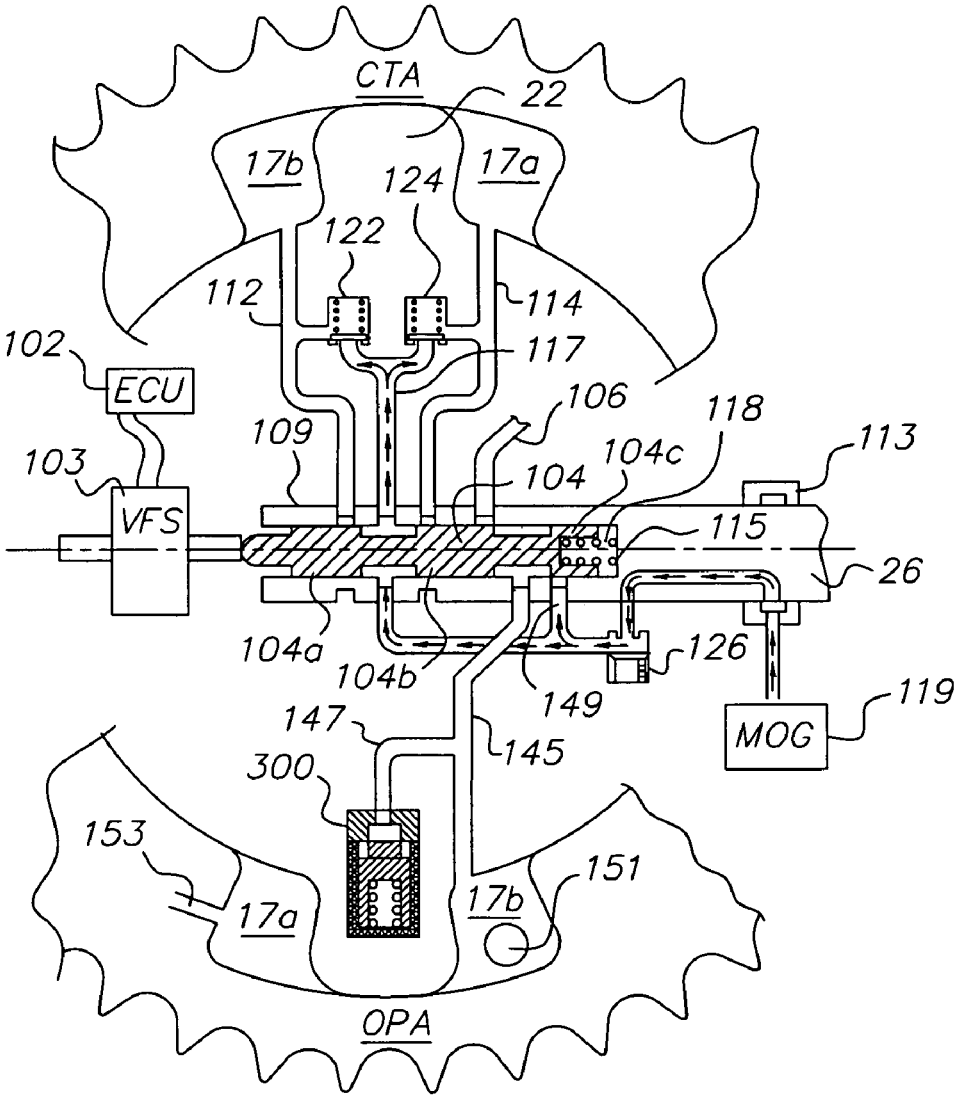
FIG. 4 shows a schematic of the present invention in null position.
Figure 5:
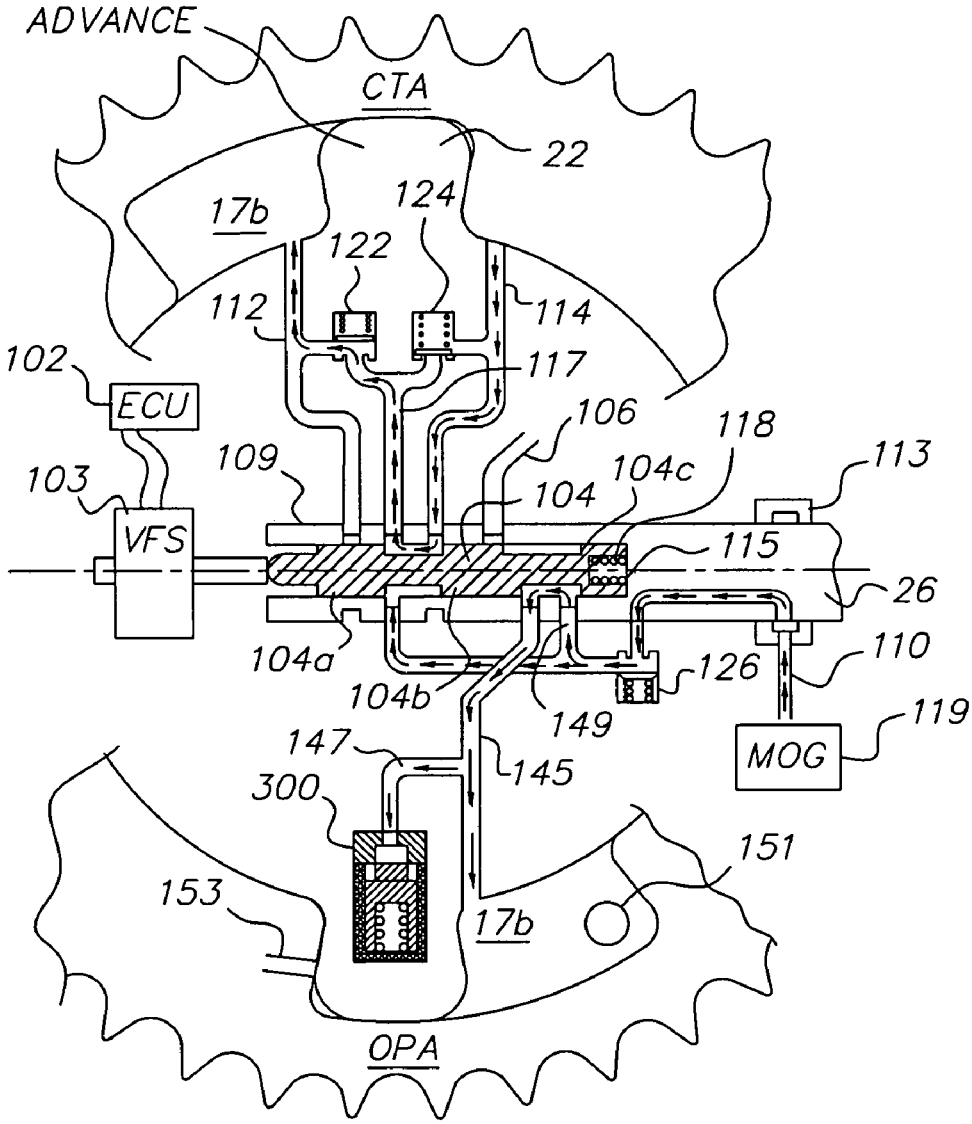
FIG. 5 shows a schematic of the present invention in advance position.
Figure 6:
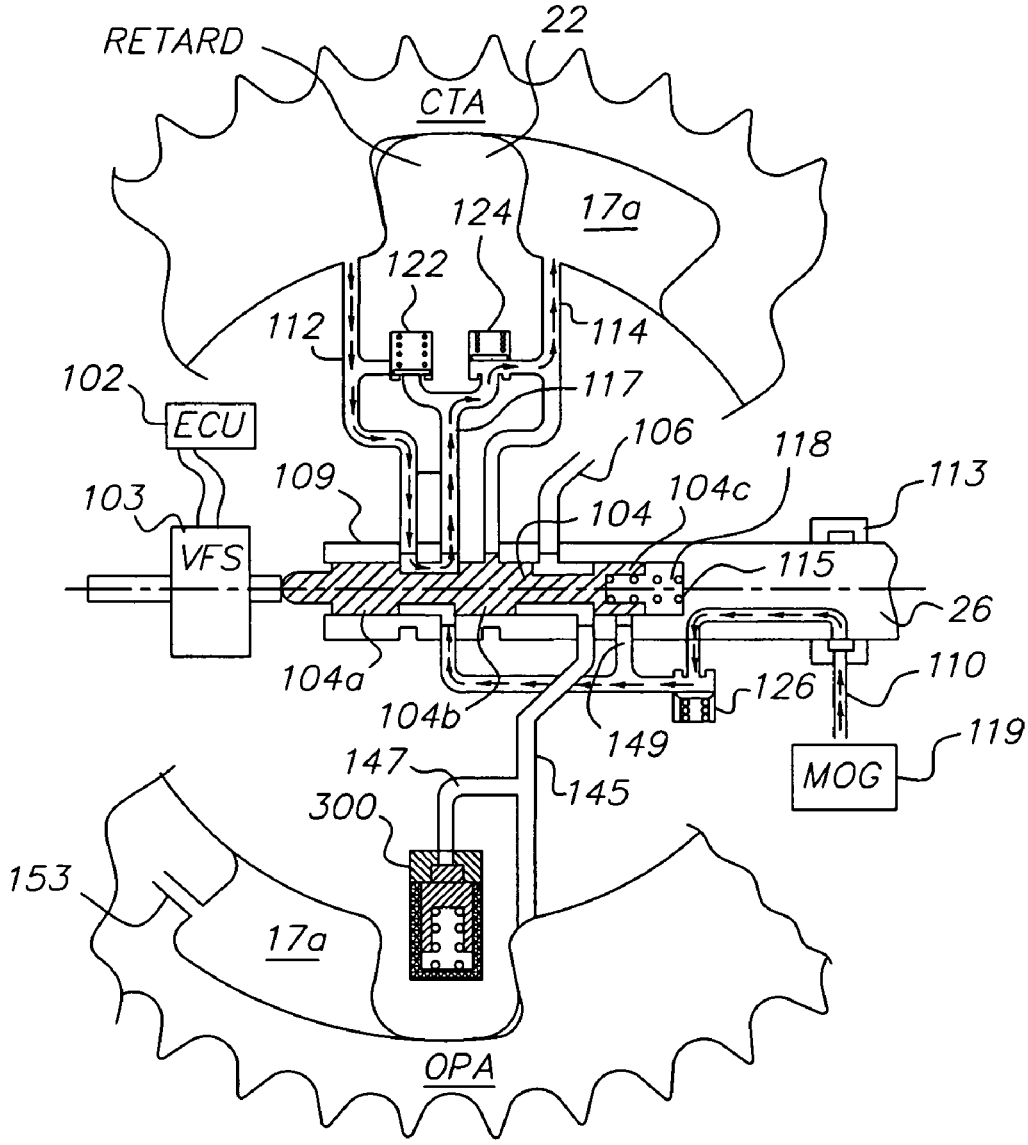
FIG. 6 shows a schematic of the present invention in retard position.
Figure 7:
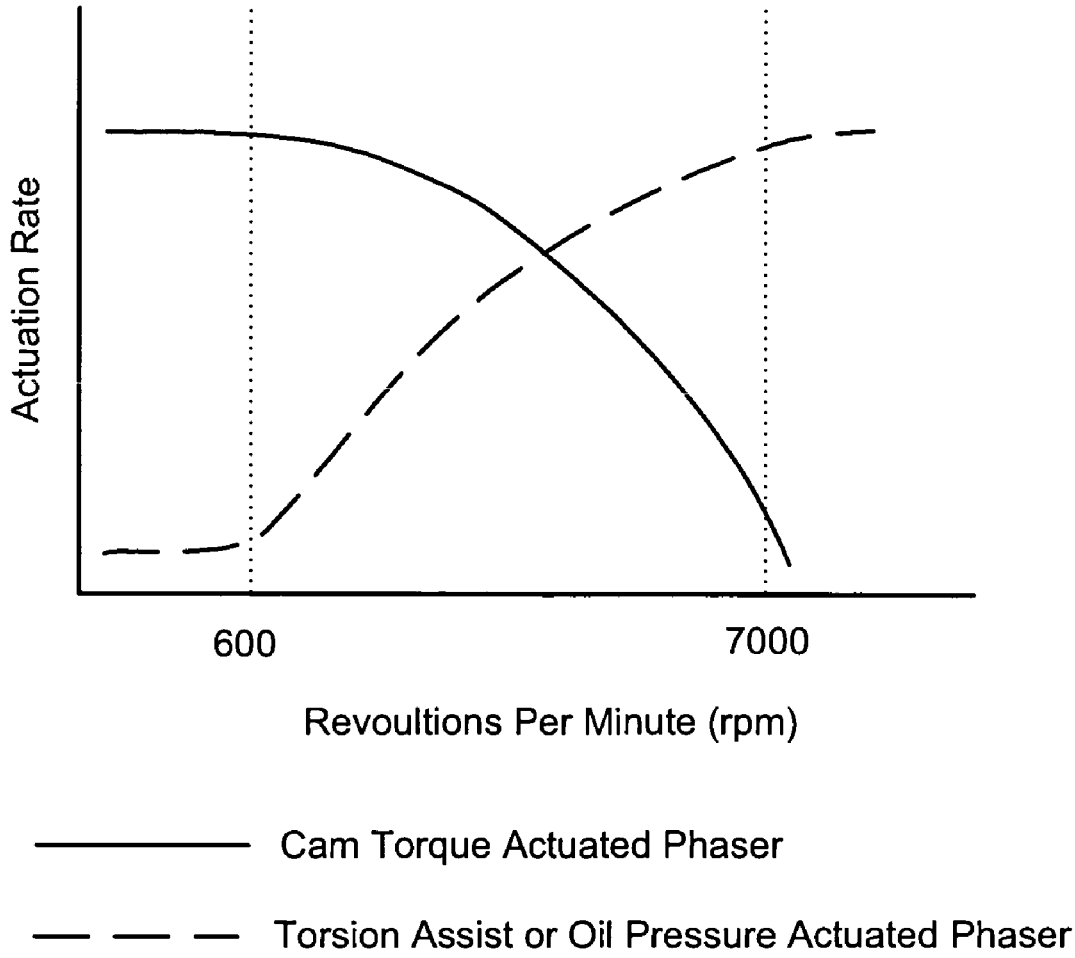
FIG. 7 shows a graph of actuation rate versus revolutions per minute (rpm) for an oil pressure actuated/torsion assist phaser and a cam torque actuated phaser.

FIGS. 4–6 show the null, advance and retard positions of phaser respectively. The phaser operating fluid, illustratively in the form of engine lubricating oil flows into the chambers 17*a* (labeled "A" for "advance") and 17*b* (labeled "R" for "retard") is introduced into the phaser by way of a common inlet line 110 connected to the main oil gallery 119. Inlet line 110 enters the phaser through bearing 113 of the camshaft 26. The common inlet line 110 contains check valve 126, which may or may not be present to prevent any back flow of oil into the main oil gallery 119. If the check valve 126 is present, then the vane is torsion assist (TA) and if the check valve 126 is not present, the vane is oil pressure actuated (OPA). Inlet line 110 branches into two paths, both of which terminate as they enter the spool valve 109. One branch of inlet line 110 leads to supply line 117 and the other branch, line 149, leads to line 145. Line 145 branches into two paths, one of which supplies oil to chamber 17*b*, and the other line 147 which leads to locking pin 300.

Locking pin 300 locks only when it is received in receiving hole 151 in chamber 17*b*. The receiving hole 151 may be located at the full advanced stop, the fully retarded stop, or slightly away from the stop, depending on whether the cam phaser is intake or exhaust. Intake cam phasers are usually locked in the full retard position when the engine is started and exhaust cam phasers are usually locked in the full advance position when the engine is started. The locking pin 300 is slidably located in a radial bore in the rotor comprising a body having a diameter adapted to a fluid-tight fit in the radial bore. The inner end of the locking pin 300 is adapted to fit in receiving hole 151 defined by the housing 24. The locking pin 300 is radially movable in the bore from a locked position in which the inner end fits into the receiving hole 151 defined by the housing 24 to an unlocked position in which the inner end does not engage the receiving hole 151 defined by the housing 24.

The spool valve 109 is made up of a spool 104 and a cylindrical member 115. The spool 104 is slidable back and forth and includes spool lands 104*a*, 104*b*, and 104*c*, which fit snugly within cylindrical member 115. The spool lands 104*a*, 104*b*, and 104*c* are preferably cylindrical lands and preferably have three positions, described in more detail below. The position of the spool within the cylindrical member 115 is influenced by spring 118, which resiliently urges the spool to the left (as shown in FIGS. 4–6). A variable force solenoid (VFS) 103 urges the spool to the right in response to control signals from the engine control unit (ECU) 102.

To maintain a phase angle, the spool 104 is positioned at null, as shown in FIG. 4, cam torsional energy, oil pressure, and friction torque have to be balanced. Makeup oil from the main oil gallery 119 fills both chambers 17*a* and 17*b*. When the spool 104 is in the null position, spool lands 104*a* and 104*b* block lines 112, 114, and exhaust port 106. Line 117 remains unblocked and is the source of the makeup oil. Supply line 117 branches into two lines, each connecting to lines 112 and 114. The branches of line 117 contain check valves 122 and 124 to prevent back flow of oil into supply line 117. Since lines 112, 114, and exhaust port 106 are blocked by the spool 104, pressure is maintained in chambers 17*a* and 17*b*. Spool land 104*c* partially blocks line 149. The partial blockage of line 149 allows enough oil to enter line 145 and 147 to unlock the locking pin from the receiving hole to move the vane and then maintain vane 22 with locking pin 300 in the null position. The locking pins tip drags along the inside of the phaser since receiving hole 151 is not present.

FIG. 5 shows the phaser in the advance position. To move to the advance position the spool 104 is moved to the right, compressing spring 118 within the cylindrical member 115. A small amount of oil is supplied to the locking pin 300 to unlock the pin 300 from the receiving hole 151 if the prior position was retard. Oil pressure from the main oil gallery aids in commanding the phaser to the advanced position in addition to the oil pressure used to push the vane on the oil pressure actuated side containing the locking pin 300. Oil flows from the main oil gallery 119 through common inlet line 110 into line 145 and line 117. The oil in line 117 flows into line 112, through check valve 122 filling chamber 17*b*, aiding the vane, in addition to what little cam torsional energy is present, to move to the advance position. In moving vane 22, any oil in chamber 17*a* is forced out into line 114 which leads back into line 117. The oil in line 149 leads to lines 147 and 145, filling chamber 17*b* and aiding the vane into moving in addition to cam torsional energy. Any oil that was present in chamber 17*a* is forced out vent 153. The locking pin 300 remains in the unlocked position since the receiving hole 151 is not present when the vane 22 is in the advance position. By using the oil pressure aid when moving the phaser to the advance position, the phaser may be used at both high rpm, when little cam torsional energy is present and low rpm when oil pressure is low.

FIG. 6 shows the phaser in the retard position. The phaser may be in this position during periods of low torsional energy because the friction of the cam bearing is trying to return the phaser to the retard position during low and high speeds. During low engine speeds, the spool 104 is moved to the left, against the force of the variable force solenoid 103 and cam torsional energy moves the phaser to the retard position. Oil pressure plays a minimal role in aiding the moving of the vane to the retard position and is present for makeup oil. The oil in line 117 flows into line 114 through check valve 124, filing chamber 17*a*, aiding in moving the vane to the retard position. Any oil in chamber 17*b* is forced out into. line 112, which leads back into line 117. Spool land 104*c* blocks line 149, preventing any oil from reaching the locking pin 300. Oil that was present in chamber 17*b* is received by line 145, which leads to vent 106. In the retard position, the locking pin 300 is received by hole 151.

At high speeds, friction of the cam bearing provides a significant drag that aids in moving the phaser to a retard position. Locking pin 300 is received by hole 151 and remains in the locked position.

It should be noted that check valve 126 is shown in FIGS. 4 through 6. By adding the check valve to line 110, the vane with the lock pin is torsion assisted (TA). If the check valve is not present, the vane with the lock pin is oil pressure actuated (OPA).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing phaser for an internal combustion engine having at least one camshaft comprising:

a housing having an outer circumference for accepting drive force;

a rotor for connection to a camshaft coaxially located within the housing, the housing and the rotor defining at least one vane separating a chamber in the housing into an advance chamber and a retard chamber;

a plurality of vanes in the chambers defined by the housing, wherein at least one CTA vane is cam torque actuated and at least one other OPA vane is oil pressure actuated; and a spool valve located along a rotational axis of the phaser and coupled to a source of oil pressure, the advance chamber and the retard chamber defined by the CTA vane and at least the advance chamber defined by the OPA vane, the spool valve having:

an advanced position wherein fluid is routed from the retard chamber defined by the CTA vane to the advance chamber defined by the CTA vane and from a supply of oil to the advance chamber of the OPA vane; and a retard position wherein fluid is routed from the advance chamber defined by the CTA vane to the retard chamber defined by the CTA vane.

2. The variable camshaft timing phaser of claim 1, further comprising:

a locking pin in at least one of the vanes, controlled by oil pressure, slidably located in a radial bore, comprising a body having a diameter adapted to a fluid-tight fit in the radial bore, and an inner end toward the housing adapted to fit in a receiving hole defined by the housing, the locking pin being radially movable in the bore from a locked position in which the inner end fits into the receiving hole defined by the housing, to an unlocked position in which the inner end does not engage the receiving hole defined by the housing.

3. The variable camshaft timing phaser of claim 2, wherein the receiving hole defined by the housing is located at full retard stop or full advance stop.

4. The variable camshaft timing phaser of claim 1, further comprising a check valve in the pressurized oil source.

5. A method of actuating a phaser at low cam torsionals, comprising the steps of:

a) providing a variable cam timing phaser comprised of:

a housing having an outer circumference for accepting drive force;

a rotor for connection to a camshaft coaxially located within the housing, the housing and the rotor defining at least one vane separating a chamber in the housing into an advance chamber and a retard chamber;

a plurality of vanes in the chambers defined by the housing, wherein at least one CTA vane is cam torque actuated and at least one other OPA vane is oil pressure actuated; and a spool valve located along a rotational axis of the phaser and coupled to a source of oil pressure, the advance chamber and the retard chamber defined by the CTA vane and at least the advance chamber defined by the OPA vane;

b) moving the spool valve of the phaser to an advanced position, wherein fluid is routed from the retard chamber defined by the CTA vane to the advance chamber defined by the CTA vane and from a supply of pressurized oil to the advance chamber of the OPA vane when the engine rpm is high, such that oil pressure actuation aids the actuation of the phaser; and c) moving the spool to a retard position wherein fluid is routed form the advance chamber defined by the CTA vane to the retard chamber defined by the CTA vane when engine rpm is low, such that the phaser is primarily cam torque actuated.

* * * * *

UNITED STATES PATENT AND TRADEMARK OFFICE

CERTIFICATE OF CORRECTION

PATENT NO. : 6,997,150 B2
DATED : February 14, 2006
INVENTOR(S) : Roger T. Simpson It is certified that error appears in the above-identified patent and that said Letters Patent is hereby corrected as shown below:

Column 6,
Line 58, delete "form" and add -- from --.

Signed and Sealed this

Sixteenth Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,997,150 B2
APPLICATION NO. : 10/984592
DATED : February 14, 2006
INVENTOR(S) : Roger T. Simpson It is certified that error appears in the above-identified patent and that said Letters Patent is hereby corrected as shown below:

Column 3, line 62: Delete the word “chambers” and add the words “retard chambers”

Column 3, line 63: Delete the words “(labeled “A” for “advance”"

Column 3, line 63: Add the words “advance chambers” between the word (and) and the number (17b)

Column 3, line 63-64: Delete the words “(labeled “R” for “retard”)”

Signed and Sealed this

Thirty-first Day of March, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 6,997,150 B2
APPLICATION NO. : 10/984592
DATED : February 14, 2006
INVENTOR(S) : Roger T. Simpson It is certified that error appears in the above-identified patent and that said Letters Patent is hereby corrected as shown below:

Column 3, line 62: Delete the word "chambers" and add the words "retard chambers"

Column 3, line 63: Delete the words "(labeled "A" for "advance")"

Column 3, line 63: Add the words "advance chambers" between the word (and) and the number (17b)

Column 3, line 63-64: Delete the words "(labeled "R" for "retard")"

This certificate supersedes the Certificate of Correction issued March 31, 2009.

Signed and Sealed this

Eighth Day of September, 2009

David J. Kappos

David J. Kappos
*Director of the United States Patent and Trademark Office*